US009240627B2

(12) United States Patent
Tseng et al.

(10) Patent No.: US 9,240,627 B2
(45) Date of Patent: Jan. 19, 2016

(54) HANDHELD DEVICE AND PLANAR ANTENNA THEREOF

(75) Inventors: Chun-Wei Tseng, Taoyuan County (TW); Chien-Chih Chen, Taoyuan County (TW); Yen-Liang Kuo, Taoyuan County (TW); Wan-Ming Chen, Taoyuan County (TW)

(73) Assignee: HTC CORPORATION (TW)

( * ) Notice: Subject to any disclaimer, the term of this patent is extended or adjusted under 35 U.S.C. 154(b) by 150 days.

(21) Appl. No.: 13/277,539

(22) Filed: Oct. 20, 2011

(65) Prior Publication Data

US 2013/0099996 A1 Apr. 25, 2013

(51) Int. Cl.
*H01Q 1/24* (2006.01)
*H01Q 9/42* (2006.01)
*H01Q 5/371* (2015.01)

(52) U.S. Cl.
CPC ..... *H01Q 1/243* (2013.01); *H01Q 5/371* (2015.01); *H01Q 9/42* (2013.01)

(58) Field of Classification Search
USPC ..... 343/876, 700 MS, 702
See application file for complete search history.

(56) References Cited

U.S. PATENT DOCUMENTS 6,753,815 B2 * 6/2004 Okubora ..... H01Q 1/243 343/700 MS
6,819,290 B2 * 11/2004 Hani ..... H01Q 1/243 343/700 MS
6,836,249 B2 12/2004 Kenoun et al.
7,321,335 B2 * 1/2008 Egorov ..... H01Q 1/243 343/700 MS
2002/0105474 A1 8/2002 Kitamura et al.
2004/0119651 A1 6/2004 Leclerc et al.
2007/0069956 A1 * 3/2007 Ozkar ..... H01Q 5/00 343/700 MS
2007/0268191 A1 11/2007 Ishizuka et al.
2008/0305750 A1 * 12/2008 Alon et al. ..... 455/77
2009/0066584 A1 3/2009 Thornell-Pers
2009/0115674 A1 5/2009 Fujieda et al.
2009/0128428 A1 5/2009 Ishizuka et al.
2009/0224996 A1 9/2009 Kim et al.

(Continued)

FOREIGN PATENT DOCUMENTS

CN 1914765 A 2/2007
CN 101809813 A 8/2010

(Continued)

OTHER PUBLICATIONS

German Office Action for Application No. 10 2012 219 263.8; Date of Mailing: Apr. 15, 2013; 10 pgs.

(Continued)

*Primary Examiner* — Hoang V Nguyen
*Assistant Examiner* — Hai Tran
(74) *Attorney, Agent, or Firm* — Cantor Colburn LLP

(57) ABSTRACT

A handheld device and a planar antenna thereof are provided. The planar antenna comprises a radiator with an open terminal, a short terminal, a first feeding terminal and a second feeding terminal. The short terminal is coupled to a ground terminal. The first feeding terminal is formed between the open terminal and the short terminal, and coupled to a radio frequency (RF) signal terminal. The second feeding terminal is formed between the open terminal and the first feeding terminal, and coupled to the first feeding terminal by a transmission line and a switch element. The radiator resonates at the first central frequency when the switch element is turned off, and resonates at the second central frequency when the switch element is turned on.

12 Claims, 6 Drawing Sheets

(56) References Cited

U.S. PATENT DOCUMENTS

| | | | | |
|---|---|---|---|---|
| 2010/0033397 | A1 | 2/2010 | Narasimhan et al. | |
| 2010/0149053 | A1 | 6/2010 | Nakano et al. | |
| 2010/0195753 | A1 * | 8/2010 | Yamamoto ..... | H01Q 1/243 375/267 |
| 2010/0259455 | A1 | 10/2010 | Thornell-Pers | |
| 2011/0102290 | A1 | 5/2011 | Milosavljevic | |

FOREIGN PATENT DOCUMENTS

| | | | |
|---|---|---|---|
| DE | 10047903 | A1 | 4/2002 |
| DE | 112004000869 | T5 | 3/2006 |
| DE | 102008063198 | A1 | 1/2010 |
| DE | 11209001935 | T5 | 2/2012 |
| FR | 2849288 | A1 | 6/2004 |
| JP | 2010166287 | A | 7/2010 |
| WO | 0128038 | A1 | 4/2001 |
| WO | 2008117558 | A1 | 10/2008 |
| WO | 2011021027 | A2 | 2/2011 |

OTHER PUBLICATIONS

J. Liang and H.Y.D. Yang; "Varactor Loaded Tunable Printed PIFA"; Progress in Electromagnetics Research B, vol. 15, pp. 113-131, 2009; 20 pgs.

Liang, Jing, Ph.D.; "Frequency reconfirgurability analysis of electrically small antenna"; ProQuest—Dissertations & Theses; University of Illinois at Chicago; 2008; 2 pgs.

Songnan Yang et al.; "Frequency-Reconfigurable Antennas for Multiradio Wireless Platforms"; IEEE Micorwave magazine; pp. 66-83; Feb. 2009; 20 pgs.

Office Action to the Chinese patent application No. 201210025323.7, May 21, 2014. Partial english summary attached.

Chinese Office Action corresponding to Application No. 201210025323.7; Date of Mailing: Jun. 11, 2015.

Taiwanese Office Action corresponding to Application No. 10420789330 ; Date of Mailing: Jun. 16, 2015.

* cited by examiner

HANDHELD DEVICE AND PLANAR ANTENNA THEREOF

REPRESENTATIVE FIGURE (i) Representative Figure: FIG. 1

(ii) Brief description of reference numerals of the representative figure:

1: handheld device
11: housing
111: receiving space
13: circuit board
131: RF signal terminal
133: ground terminal
15: planar antenna
151: first radiator
153: open terminal
155: short terminal
157: first feeding terminal
159: second feeding terminal
17: transmission line
19: switch element
2: RF signal

CHEMICAL FORMULA BEST CHARACTERIZING THE INVENTION

None

DESCRIPTION OF THE INVENTION

1. Field of the Invention

The subject application relates to a handheld device and a planar antenna thereof. More particularly, the planar antenna of the subject application has a radiator thereof resonated at two central frequencies by means of a transmission line and a switch element.

2. Descriptions of the Related Art

As modern people's demands on wireless communication have increased, handheld devices (e.g., mobile phones, notebook computers and tablet computers) have gradually become indispensable. To meet modern people's demands on handheld devices, handheld device manufacturers all try to design handheld devices to be more humanized or more adapted for people's needs.

Over recent years, as various wireless communication systems have developed in succession, most of the handheld devices on the market have already been able to support wireless communication systems of two or more communication frequency bands. Since different wireless communication systems usually use different frequency bands to transmit signals, conventional manufacturers usually install a plurality of antennas in one handheld device so that the handheld device can operate within different frequency bands depending on the different wireless communication systems. However, in consideration of various factors such as the cost, appearance, inner space of the handheld device and transmission quality, the conventional manufacturers' method for achieving multi-frequency operability has gradually become unacceptable in the market. To impart the handheld devices with the multi-frequency operability, conventional manufacturers have tried to adopt antennas with multi-frequency operability. Among these antennas, a planar inverted-F antenna (PIFA) with a slim profile has attracted the most attention.

The conventional single-frequency planar inverted-F antenna has only a radiator of about ¼ wavelength as a resonant current path. In addition, if the conventional single-frequency planar inverted-F antenna is to operate at a plurality of frequencies, then other parasitic antenna elements must be added and/or other branches must be formed. Thus, to have the conventional planar inverted-F antenna operate at a plurality of frequencies, the area of the radiator must be increased, which inevitably increases the size of the antenna. In case both the clearance area of the antenna of the handheld device and the inner space of the handheld device itself are not large enough, the transmission performance of the antenna will be compromised more easily.

Accordingly, to make the conventional multi-frequency planar inverted-F antenna widely accepted in the market, the following problems must be further improved: (1) the handheld device needs to be lightweight and slim, even though the size of the antenna is increased; and (2) the antenna is not completely placed within the clearance area to improve the transmission performance. In addition, the conventional multi-frequency planar inverted-F antenna cannot be flexibly switched among multiple frequency bands.

In view of this, it is important to provide a handheld device and a planar antenna thereof, which can effectively overcome the shortcomings of the conventional multi-frequency planar antenna such as an excessively large size, poor transmission performance and incapability of being flexibly switched among multiple frequency bands.

3. Contents of the Invention

An objective of the subject application is to provide a handheld device and a planar antenna thereof. The planar antenna has a small size and good transmission performance, and is capable of being flexibly switched among multiple frequency bands. Furthermore, the planar antenna of the subject application can operate at multiple frequencies without the need of adding other parasitic antenna elements and/or forming other branches, so it has a reduced size as compared to the conventional multi-frequency planar antenna. On the other hand, because of the reduced size of the antenna, it becomes easier to place the planar antenna of the subject application within the clearance area of the handheld device completely. As a result, the influence of electronic elements, which are disposed outside the clearance area, on the planar antenna can be reduced to improve the transmission performance of the planar antenna. In addition, the planar antenna of the subject application can be flexibly switched by a user among multiple frequency bands by simply using a transmission line and a switch element. As a result, the design of the planar antenna of the subject application becomes easier than planar antennas in adopting the conventional multi-frequency antenna switching technology.

To achieve the aforesaid objective, the subject application discloses a planar antenna, which comprises a first radiator. The first radiator comprises an open terminal, a short terminal, a first feeding terminal and a second feeding terminal. The short terminal is coupled to a ground terminal. The first feeding terminal is formed between the open terminal and the short terminal, and coupled to a radio frequency (RF) signal terminal. The second feeding terminal is formed between the open terminal and the first feeding terminal, and coupled to the first feeding terminal via a transmission line and a switch element. When the switch element is turned off, an RF signal outputted by the RF signal terminal is fed from the first feeding terminal to the first radiator so that the first radiator resonates at a first central frequency. When the switch element is turned on, the RF signal outputted by the RF signal terminal is fed at least from the second feeding terminal to the first radiator so that the first radiator resonates at a second central frequency. Furthermore, the second central frequency is higher than the first central frequency.

To achieve the aforesaid objective, the subject application further discloses a handheld device, which comprises a housing, a circuit board and a planar antenna. The housing is configured to define a receiving space. The circuit board is disposed in the receiving space and comprises a radio frequency (RF) signal terminal and a ground terminal. The planar antenna is disposed in the receiving space and comprises a first radiator. The first radiator comprises an open terminal, a short terminal, a first feeding terminal and a second feeding terminal. The short terminal is coupled to the ground terminal. The first feeding terminal is formed between the open terminal and the short terminal, and is coupled to the RF signal terminal. The second feeding terminal is formed between the open terminal and the first feeding terminal, and coupled to the first feeding terminal via a transmission line and a switch element. When the switch element is turned off, an RF signal outputted by the RF signal terminal is fed from the first feeding terminal to the first radiator so that the first radiator resonates at a first central frequency. When the switch element is turned on, the RF signal outputted by the RF signal terminal is fed from the second feeding terminal to the first radiator so that the first radiator resonates at a second central frequency. Furthermore, the second central frequency is higher than the first central frequency.

The detailed technology and preferred embodiments implemented for the present invention are described in the following paragraphs accompanying the appended drawings for people skilled in this field to well appreciate the features of the claimed invention.

DESCRIPTION OF THE PREFERRED EMBODIMENT

In the following descriptions, the present invention will be explained with reference to embodiments thereof. It shall be appreciated that these embodiments are not intended to limit the present invention to any specific environment, applications or particular implementations described in these embodiments. Therefore, the description of these embodiments is only for the purpose of illustration rather than to limit the present invention, and the scope of this application shall be governed by the claims. In addition, in the following embodiments and the attached drawings, elements not directly related to the present invention are omitted from depiction; and dimensional relationships among individual elements in the attached drawings are illustrated only for ease of understanding but not to limit the actual scale.

In reference to FIG. 1, the first embodiment of the present invention is a handheld device 1. Specifically, FIG. 1 is a schematic plan view of the handheld device 1. As shown in FIG. 1, the handheld device 1 at least comprises a housing 11, a circuit board 13 and a planar antenna 15. It shall be appreciated that the handheld device 1 in this embodiment may be a handheld electronic device with a wireless transmission function such as a mobile phone, a notebook computer or a tablet computer. In addition, for simplicity of description, other modules (e.g., a touch display module, a communication module, a central processing module, an input module and a power supply module) of the handheld device 1 that are not directly related to the present invention are all omitted from depiction in FIG. 1.

The housing 11 is adapted to define a receiving space 111 for receiving internal elements and modules of the handheld device 1. The circuit board 13 is disposed in the receiving space 111 and comprises a radio frequency (RF) signal terminal 131 and a ground terminal 133. The RF signal terminal 131 is configured to output/receive an RF signal 2 of the handheld device 1, while the ground terminal 133 is in the common ground position at a relative zero potential. In addition, the planar antenna 15 is arranged on a carrier (not shown) and disposed in the receiving space 111 and comprises a first radiator 151. The first radiator 151 comprises an open terminal 153, a short terminal 155, a first feeding terminal 157 and a second feeding terminal 159. It shall be appreciated that the planar antenna 15 of this embodiment is in the form of a planar inverted-F antenna (PIFA), and this is only intended to illustrate this embodiment but not to limit the present invention.

As shown in FIG. 1, the open terminal 153 of the planar antenna 15 presents an open state; and the short terminal 155 of the planar antenna 15 is coupled to the ground terminal 133 of the circuit board 13 and thus, presents a short state. The first feeding terminal 157 is formed between the open terminal 153 and the short terminal 155, and is coupled to the RF signal terminal 131. The second feeding terminal 159 is formed between the open terminal 153 and the first feeding terminal 157, and is coupled to the first feeding terminal 157 via a transmission line 17 and a switch element 19. It shall be appreciated that the open terminal 153, the short terminal 155, the first feeding terminal 157 and the second feeding terminal 159 of this embodiment only represent the estimated positions, and not the exact positions, on the first radiator 151. In addition, the switch element 19 may be an automatic switch, an electronic switch, a micro-electronic switch, a gating element or a diode element, or any kind of switch that can be turned on and off between two terminals.

The method in which the planar antenna 15 of this embodiment operates at multiple frequencies will be described hereinafter. When the switch element 19 is turned off, the planar antenna 15 is equivalent to a conventional single-frequency PIFA. Then, according to the physical properties of the conventional single-frequency PIFA, the RF signal 2 outputted by the RF signal terminal 131 is fed from the first feeding terminal 157 into the first radiator 151 via the transmission line 17 and flows to the open terminal 153 of the first radiator 151 along a first current path (not shown) so that the first radiator 151 resonates at the first central frequency. Accordingly, when the switch element 19 is turned off, the planar antenna 15 operates at the first central frequency and has a first frequency band.

When the switch element 19 is turned on, apart from being fed from the first feeding terminal 157 into the first radiator 151 via the transmission line 17, the RF signal 2 outputted by the RF signal terminal 131 is also fed from the second feeding terminal 159 into the first radiator 151. However, because the second feeding terminal 159 of the planar antenna 15 of the present invention is coupled to the first feeding terminal 157 via the transmission line 17 and the switch element 19, most of the RF signal 2 outputted by the RF signal terminal 131 is fed from the second feeding terminal 159 into the first radiator 151.

According to the physical properties of the conventional single-frequency PIFA, the RF signal 2 outputted by the RF signal terminal 131 will take a short current path as the primary transmission medium thereof. Because the path from the second feeding terminal 159 of the planar antenna 15 of the present invention to the open terminal 153 of the first radiator 151 is shorter than the current path from the first feeding terminal 157 to the open terminal 153 of the first radiator 151, most of the RF signal 2 outputted by the RF signal terminal 131 is fed from the second feeding terminal 159 into the first radiator 151. On the other hand, because the transmission line 17 matches the impedance of the RF signal terminal 131, the loss caused when the RF signal 2 outputted by the RF signal terminal 131 is taken by the transmission line 17 because the transmission medium is much less than the loss caused when the first radiator 151 is used as the transmission medium. Thus, the RF signal 2 outputted by the RF signal terminal 131 uses the transmission line 17 as the transmission medium when being transmitted to the first radiator 151.

As can be known from the above description, most of the RF signal 2 outputted by the RF signal terminal 131 is fed from the second feeding terminal 159 into the first radiator 151 and flows to the open terminal 153 of the first radiator 151 along a second current path (not shown) so that the first radiator 151 resonates at the second central frequency. Accordingly, when the switch element 19 is turned on, the planar antenna 15 operates at a second central frequency that is higher than the first central frequency, and has a second frequency band. It shall be appreciated that in other embodiments, a plated metal layer or a transmission line that does not match the impedance of the RF signal terminal 131 may also be adopted as the transmission line 17 to achieve the same function; and the implementation of the planar antenna 15 of this embodiment is only one of the preferred embodiments but is not intended to limit the present invention.

A further description will be made with reference to FIG. 2 hereinafter. FIG. 2 is a schematic view illustrating the reflection coefficients |S11| of the planar antenna 15 of the handheld device 1 when operating within different frequency bands. As shown in FIG. 2, the planar antenna 15 operates at the first central frequency and has a first frequency band (about 704 MHz to 746 MHz) when the switch element 19 is turned off, while the planar antenna 15 operates at a second central frequency and has a second frequency band (about 854 MHz to 894 MHz) when the switch element 19 is turned on. As can be seen from this, the planar antenna 15 of the present invention operates at two central frequencies and has two frequency bands depending on the on/off state of the switch element 19. In addition, it shall be readily appreciated by those of ordinary skill in the art that the planar antenna 15 of the present invention can flexibly operate at multiple central frequencies by using multiple transmission lines 17 and multiple switch elements 19 and has multiple frequency bands.

Referring to FIG. 3, the second embodiment of the present invention is a handheld device 3. FIG. 3 is a schematic plan view of the handheld device 3. It shall be appreciated that the handheld device 3 of this embodiment is substantially the same as the handheld device 1 of the first embodiment; and therefore, all other elements than those particularly described in this embodiment can be understood to be the same as those of the handheld device 1 of the first embodiment. Accordingly, for elements identical to those of the first embodiment, identical reference numerals will be used and descriptions thereof will be omitted herein. For the omitted descriptions, reference may be made to the aforesaid embodiment, and they will not be further described again herein.

As shown in FIG. 3, the handheld device 3 at least comprises a housing 11, a circuit board 13 and a planar antenna 15. The housing 11 is configured to define a receiving space 111. The circuit board 13 is disposed in the receiving space 111 and comprises an RF signal terminal 131, a ground terminal 133 and a direct current (DC) control terminal 135. In addition, the planar antenna 15 is also disposed in the receiving space 111 and comprises a first radiator 151. The first radiator 151 comprises an open terminal 153, a short terminal 155, a first feeding terminal 157 and a second feeding terminal 159. The first feeding terminal 157 is formed between the open terminal 153 and the short terminal 155, and coupled to the RF signal terminal 131. The second feeding terminal 159 is formed between the open terminal 153 and the first feeding terminal 157.

A difference between the handheld device 3 of this embodiment and the handheld device 1 of the first embodiment is that the second feeding terminal 159 of the first radiator 151 is coupled to the first feeding terminal 157 via a transmission line 17 and a diode element 19*a*. In addition, the diode element 19*a* is coupled to the DC control terminal 135 of the circuit board 13 via an RF choke 137. The DC control terminal 135 controls the on/off state of the diode element 19*a* by outputting a DC signal 4, and blocks an RF signal 2 outputted by the RF signal terminal 131 from being introduced into the DC control terminal 135 to avoid abnormal conditions of the DC control terminal 135 due to the introduction of the RF signal 2. On the other hand, the first feeding terminal 157 of this embodiment is coupled to the RF signal terminal 131 via a DC blocker 139 to block the DC signal 4 from being introduced into the RF signal terminal 131. Thereby, the abnormal conditions of the RF signal terminal 131 due to the introduction of the DC signal 4 can be avoided. It shall be appreciated that the RF choke 137 and the DC blocker 139 are optional elements of the handheld device 3 but are not intended to limit the present invention.

The handheld device 3 of this embodiment uses the diode element 19*a* and the DC control terminal 135 to achieve the function of the switch element 19 of the handheld device 1 of the first embodiment. According to the on/off characteristics of the diode element 19*a*, the on/off state of the diode element 19*a* is controlled by the DC signal 4 outputted by the DC control terminal 135. Accordingly, when the diode element 19*a* is turned off, the planar antenna 15 of the handheld device 3 operates at the first central frequency and has a first frequency band; and when the diode element 19*a* is turned on, the planar antenna 15 of the handheld device 3 operates at the second central frequency that is higher than the first central frequency, and has a second frequency band.

It shall be appreciated that in addition to the aforesaid description, the second embodiment can also execute all the operations and functions set forth in the aforesaid embodiment. The method in which the second embodiment executes these operations and functions will be readily appreciated by those of ordinary skill in the art based on the explanation of the aforesaid embodiment, and thus, will not be further described herein.

In reference to FIG. 4, the third embodiment of the present invention is a handheld device 5. FIG. 4 is a schematic plan view of the handheld device 5. It shall be appreciated that the handheld device 5 of this embodiment is substantially the same as the handheld device 1 of the first embodiment; and therefore, all other elements than those particularly described in this embodiment can be understood to be the same as those of the handheld device 1 of the first embodiment. Accordingly, for elements identical to those of the first embodiment, identical reference numerals will be used and descriptions thereof will be omitted herein. For the omitted descriptions, reference may be made to the first embodiment, and they will not be further described again herein.

As shown in FIG. 4, the handheld device 5 comprises a housing 11, a circuit board 13 and a planar antenna 55. The housing 11 is configured to define a receiving space 111. The circuit board 13 is disposed in the receiving space 111 and comprises an RF signal terminal 131 and a ground terminal 133. In addition, the planar antenna 55 is also disposed in the receiving space 111 and comprises a first radiator 151'. The first radiator 151' comprises an open terminal 153, a short terminal 155, a first feeding terminal 157 and a second feeding terminal 159. The first feeding terminal 157 is formed between the open terminal 153 and the short terminal 155, and is coupled to the RF signal terminal 131. The second feeding terminal 159 is formed between the open terminal 153 and the first feeding terminal 157, and is coupled to the first feeding terminal 157 via a transmission line 17 and a switch element 19.

A difference between the handheld device 5 of this embodiment and the handheld device 1 of the first embodiment is that the planar antenna 55 of the handheld device 5 further comprises a second radiator 152. The second radiator 152 is coupled to the open terminal 153 of the first radiator 151' via a screening element 154 so that the planar antenna 55 can operate at the first central frequency and third central frequency when the switch element 19 is turned off and at the second central frequency and fourth central frequency when the switch element 19 is turned on. In this embodiment, the total current path length of the first radiator 151' and the second radiator 152 is shorter than the current path length of the first radiator 151 in the first embodiment. Furthermore, the individual current path lengths of the first radiator 151' and the second radiator 152 can be adjusted as desired on this premise. Thus, as compared with the first embodiment, this embodiment can additionally provide two central frequencies with the size of the planar antenna 55 maintained and even reduced. It is worth noting that the first radiator 151 of the first embodiment may be divided into the first radiator 151' and the second radiator 152 of this embodiment to achieve the multi-band operability of this embodiment. Therefore, on the whole, the current path of this embodiment would still be viewed as being comprised of a single radiator and the multi-band operability can be achieved without the need of adding other elements and/or branches.

The screening element 154 may be an elongated transmission line or a combination of passive elements. The screening element 154 is used to screen frequencies in such a way that high-frequency (HF) signals cannot pass through the screening element 154 and low-frequency (LF) signals can pass through the screening element 154, so an HF path and an LF path are additionally generated. This, in combination with the control of the on/off state of the switch element 19, allows for the multi-band operability. Accordingly, when the switch element 19 is turned off, the planar antenna 55 of the handheld device 5 can further operate at the third central frequency and have a third frequency band due to the second radiator 152 and the frequency screening function of the screening element 154 operating separately from the first central frequency and first frequency band. Here, the third central frequency is lower than the first central frequency. In addition, when the switch element 19 is turned on, the planar antenna 55 of the handheld device 5 can further operate at the fourth central frequency and have a fourth frequency band due to the second radiator 152 and the frequency screening function of the screening element 154 operating separately from the second central frequency and second frequency band. Here, the fourth central frequency is lower than the second central frequency.

A further description will be made with reference to FIG. 5 hereinafter. FIG. 5 is a schematic view illustrating the reflection coefficients |S11| of the planar antenna 55 of the handheld device 5 when operating within different frequency bands. As shown in FIG. 5, the planar antenna 55 operates at a first central frequency and a third central frequency and has a first frequency band (about 1710 MHz to 1880 MHz) and a third frequency band (about 698 MHz to 712 MHz) when the switch element 19 is turned off. The planar antenna 55 operates at the second central frequency and fourth central frequency and has a second frequency band (about 1880 MHz to 2170 MHz) and fourth frequency band (about 712 MHz to 746 MHz) when the switch element 19 is turned on. As can be seen from this, the planar antenna 55 of the present invention operates at four central frequencies by use of the screening element 154 and by turning the switch element 19 on and off. The third and fourth frequency band may further cover a central operating frequency of the LTE. In addition, it shall be readily appreciated by those of ordinary skill in the art that the planar antenna 55 of the present invention can flexibly operate at multiple central frequencies by using multiple transmission lines 17 and multiple switch elements 19 and has multiple frequency bands.

It shall be appreciated that in addition to the aforesaid description, the third embodiment can also execute all the operations and functions set forth in the aforesaid embodiments. The method in which the third embodiment executes these operations and functions will be readily appreciated by those of ordinary skill in the art based on the explanation of the aforesaid embodiments, and thus, will not be further described herein.

In reference to FIG. 6, the fourth embodiment of the present invention is a handheld device 7. FIG. 6 is a schematic plan view of the handheld device 7. It shall be appreciated that the handheld device 7 of this embodiment is substantially the same as the handheld device 3 of the second embodiment; and therefore, all other elements than those particularly described in this embodiment can be understood to be the same as those of the handheld device 3 of the second embodiment. Accordingly, for elements identical to those of the second embodiment, identical reference numerals will be used and descriptions thereof will be omitted herein. For the omitted descriptions, reference may be made to the second embodiment, and they will not be further described again herein.

As shown in FIG. 6, the handheld device 7 at least comprises a housing 11, a circuit board 13 and a planar antenna 75. The housing 11 is configured to define a receiving space 111. The circuit board 13 is disposed in the receiving space 111 and comprises an RF signal terminal 131, a ground terminal 133 and a DC control terminal 135. In addition, the planar antenna 75 is also disposed in the receiving space 111 and comprises a first radiator 151'. The first radiator 151' comprises an open terminal 153, a short terminal 155, a first feeding terminal 157 and a second feeding terminal 159. The first feeding terminal 157 is formed between the open terminal 153 and the short terminal 155, and is coupled to the RF signal terminal 131. The second feeding terminal 159 is formed between the open terminal 153 and the first feeding terminal 157, and is coupled to the first feeding terminal 157 via a transmission line 17 and a diode element 19*a*.

A difference between the handheld device 7 of this embodiment and the handheld device 3 of the second embodiment is that the planar antenna 75 of the handheld device 7 further comprises a second radiator 152. The second radiator 152 is coupled to the open terminal 153 of the first radiator 151' via a screening element 154 so that the planar antenna 75 can operate at the first central frequency and third central frequency when the diode element 19*a* is turned off and at the second central frequency and fourth central frequency when the diode element 19*a* is turned on. The total current path length of the first radiator 151' and the second radiator 152 in this embodiment is shorter than the current path length of the first radiator 151 in the first embodiment; and the individual current path lengths of the first radiator 151' and the second radiator 152 can be adjusted as desired on this premise. Thus, as compared with the second embodiment, this embodiment can additionally provide two central frequencies with the size of the planar antenna 75 maintained and even reduced. It is worth noting that the first radiator 151 of the first embodiment may be divided into the first radiator 151' and the second radiator 152 of this embodiment to achieve the multi-band operability of this embodiment; and therefore, on the whole, the current path of this embodiment would still be viewed as being comprised of a single radiator, and the multi-band operability can be achieved without the need of adding other branches.

The screening element 154 may be an elongated transmission line or a combination of passive elements. The screening element 154 is used to screen frequencies in such a way that HF signals cannot pass through the screening element 154 and LF signals can pass through the screening element 154, so an HF path and an LF path are additionally generated. This, in combination with the control of the on/off state of the diode element 19*a*, can further allow for the multi-band operability. Accordingly, when the diode element 19*a* is turned off, the planar antenna 75 of the handheld device 7 can further operate at the third central frequency and have third frequency band due to the second radiator 152 and the frequency screening function of the screening element 154 operating separately from the first central frequency and first frequency band. Here, the third central frequency is lower than the first central frequency. In addition, when the diode element 19*a* is turned on, the planar antenna 75 of the handheld device 7 can further operate at the fourth central frequency and have a fourth frequency band due to the second radiator 152 and the frequency screening function of the screening element 154 operating separately from the second central frequency and second frequency band. Here, the fourth central frequency is lower than the second central frequency.

It shall be appreciated that in addition to the aforesaid description, the fourth embodiment can also execute all the operations and functions set forth in the aforesaid embodiments. The method in which the fourth embodiment executes these operations and functions will be readily appreciated by those of ordinary skill in the art based on the explanation of the aforesaid embodiments, and thus, will not be further described herein.

According to the above descriptions, the handheld device and the planar antenna thereof of the subject application can operate at the first central frequency and the second central frequency by using a transmission line and a switch element. In addition, if a screening element and another radiator are additionally provided, the handheld device and the planar antenna thereof of the subject application can additionally operate at the third central frequency and fourth central frequency. Specifically, the multi-band operability of the planar antenna of the subject application can be achieved without the need of adding other parasitic antenna elements and/or forming other branches, so the planar antenna of the subject application has a reduced size as compared to the conventional multi-frequency planar antenna.

On the other hand, because of the reduced size of the antenna, it becomes easier to place the planar antenna of the subject application within the clearance area of the handheld device completely. As a result, the influence of electronic elements, which are disposed outside the clearance area, on the planar antenna can be reduced to improve the transmission performance of the planar antenna. In addition, the planar antenna of the subject application can be flexibly switched by a user among multiple frequency bands, so the design of the planar antenna of the subject application becomes easier as compared to planar antennas adopting the conventional multi-frequency antenna switching technology. Therefore, the handheld device and the planar antenna thereof of the subject application effectively overcome the shortcomings of the conventional multi-frequency planar antenna such as an excessively large size, poor transmission performance and incapability of being flexibly switched among multiple frequency bands.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

BRIEF DESCRIPTION OF REFERENCE NUMERALS

Figure 1:
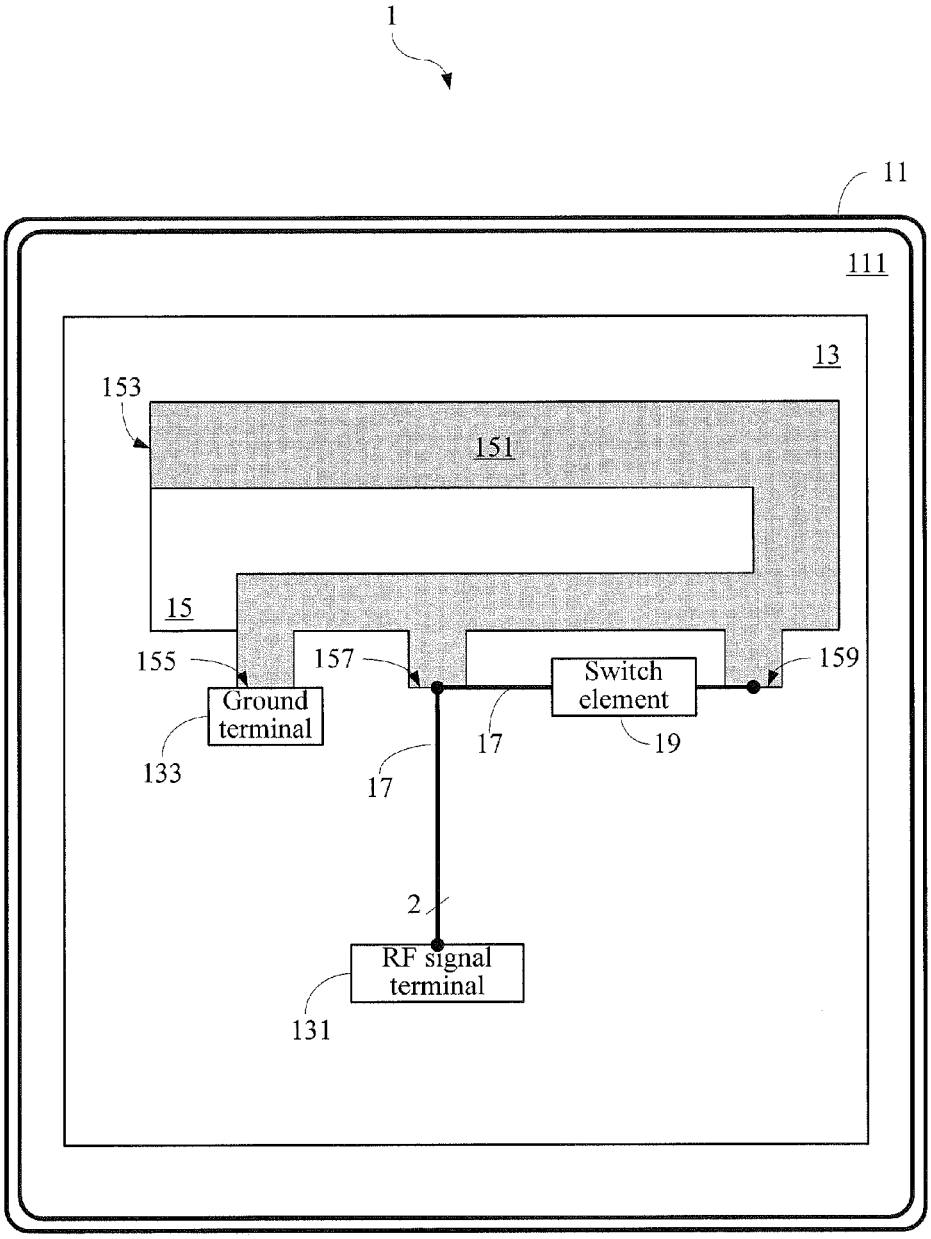
FIG. 1 is a schematic plan view of a handheld device 1 according to the first embodiment of the present invention.
Figure 2:
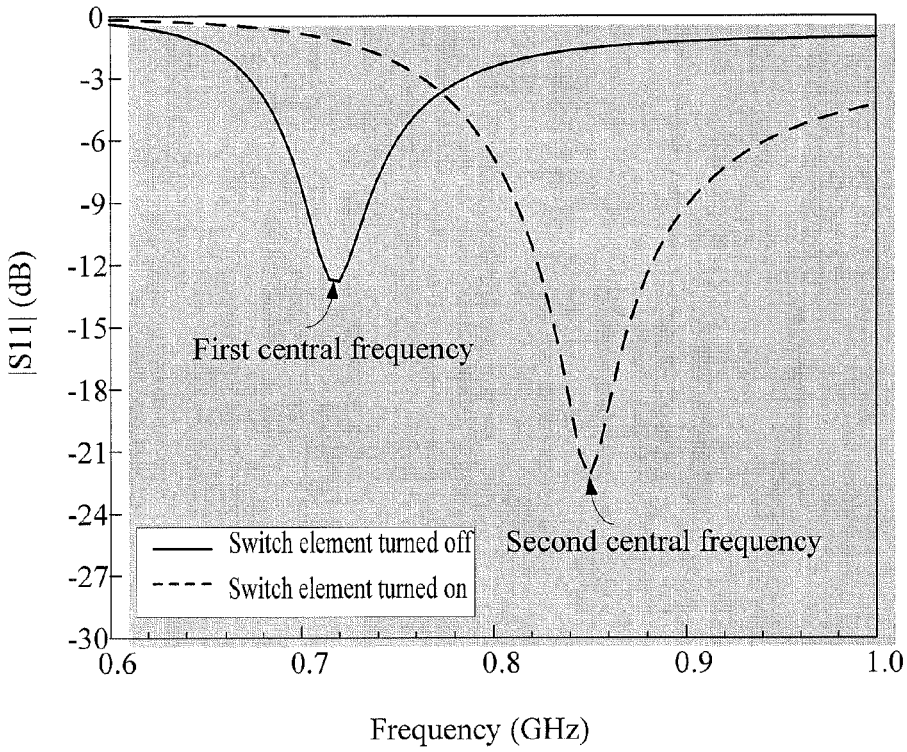
FIG. 2 is a schematic view illustrating reflection coefficients |S11| of a planar antenna 15 of the handheld device 1 according to the present invention when operating within different frequency bands.
Figure 3:
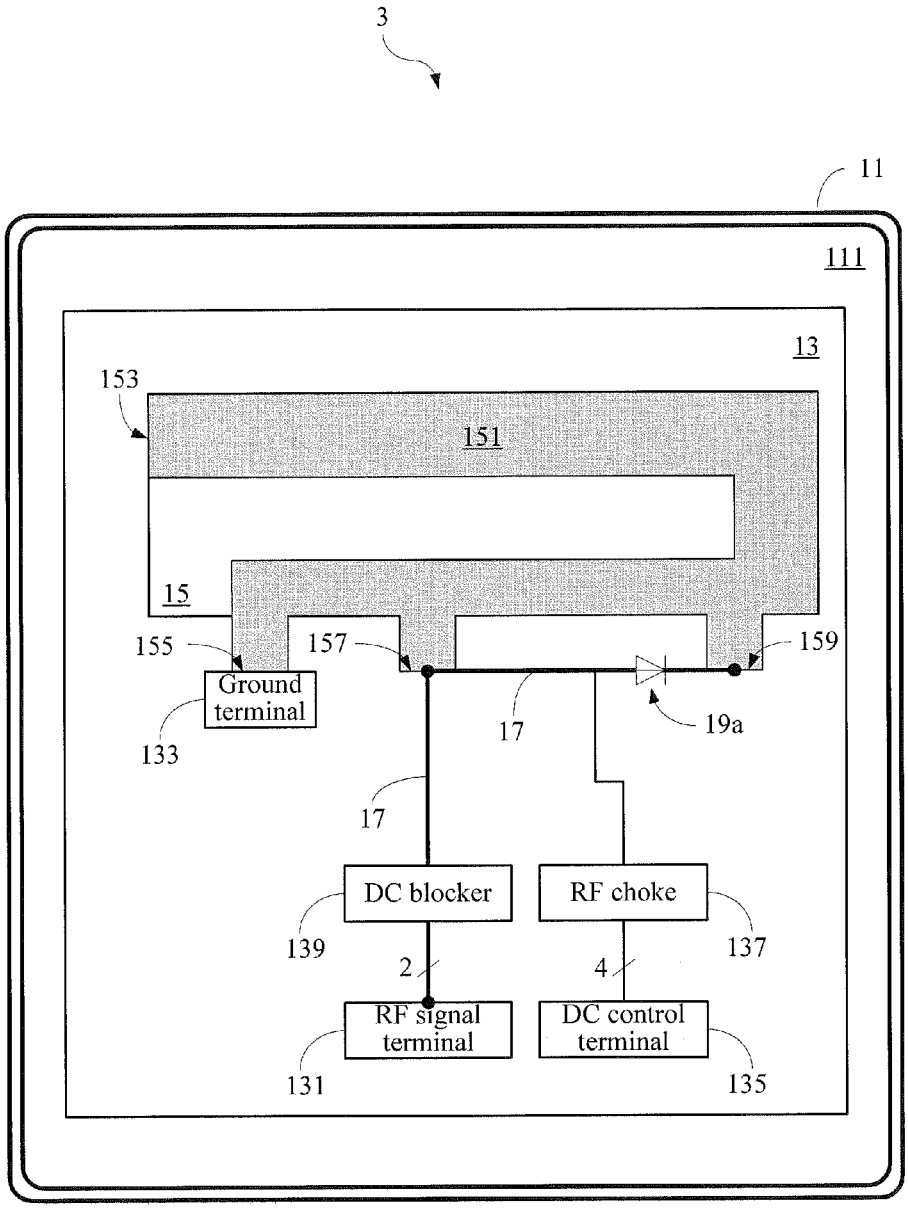
FIG. 3 is a schematic plan view of a handheld device 3 according to the first embodiment of the present invention.
Figure 4:
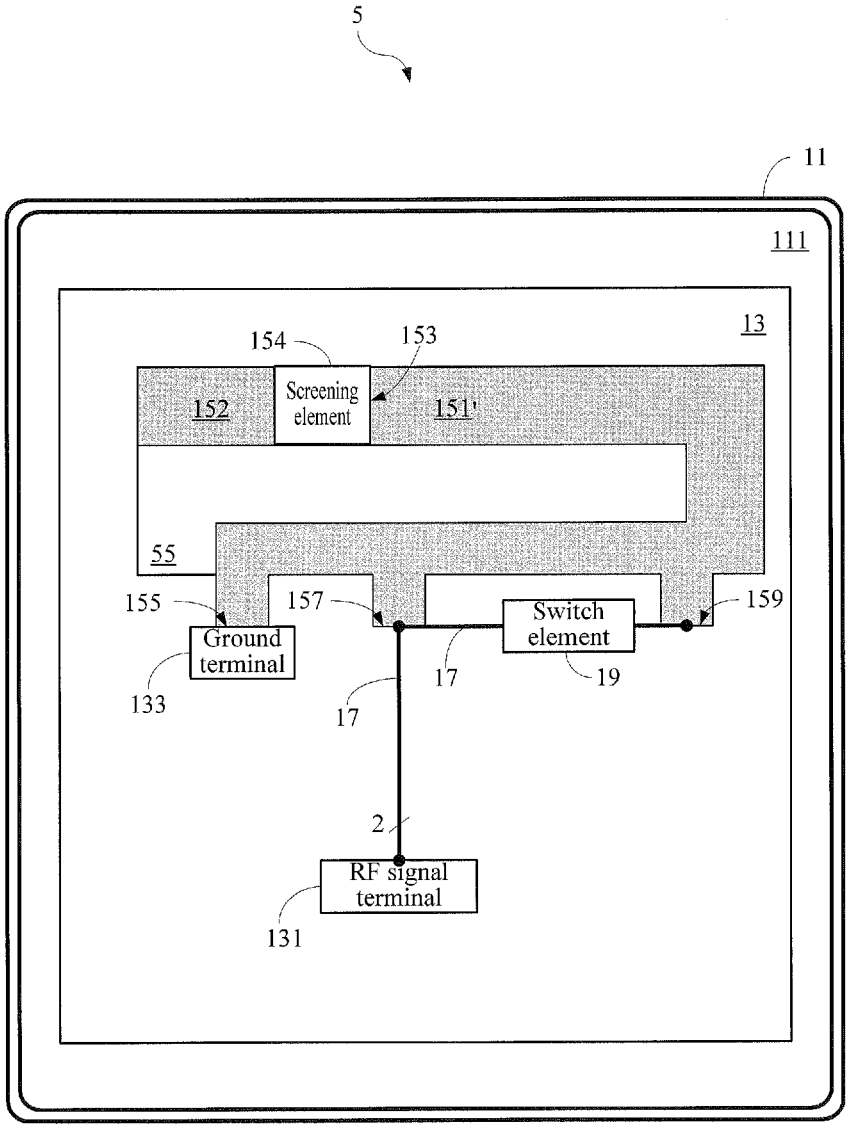
FIG. 4 is a schematic plan view of a handheld device 5 according to the second embodiment of the present invention.
Figure 5:
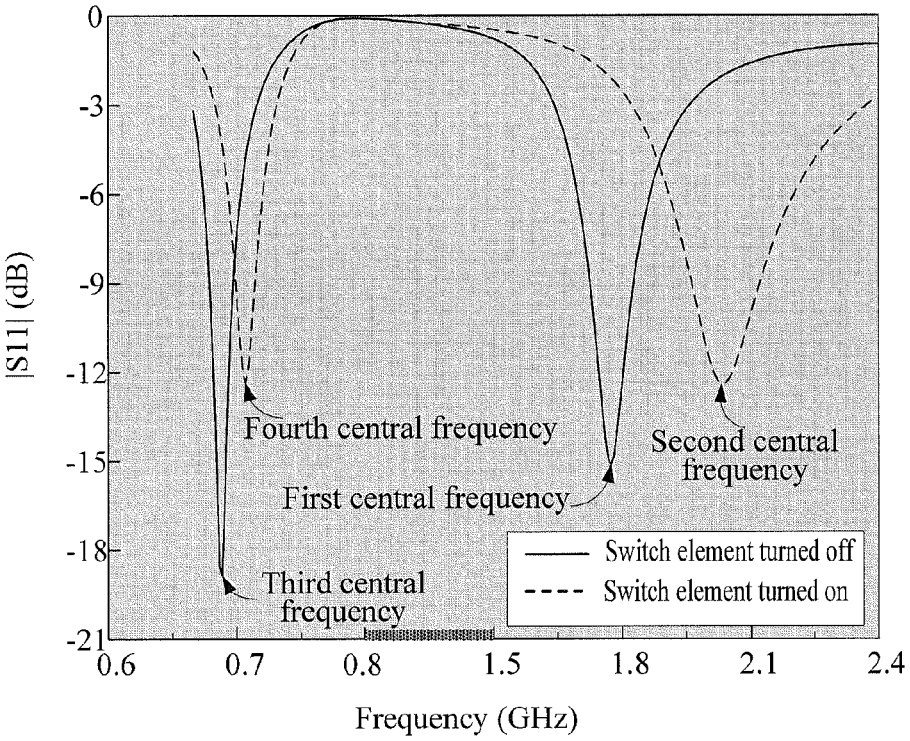
FIG. 5 is a schematic view illustrating reflection coefficients |S11| of a planar antenna 55 of the handheld device 5 according to the present invention when operating within different frequency bands.
Figure 6:
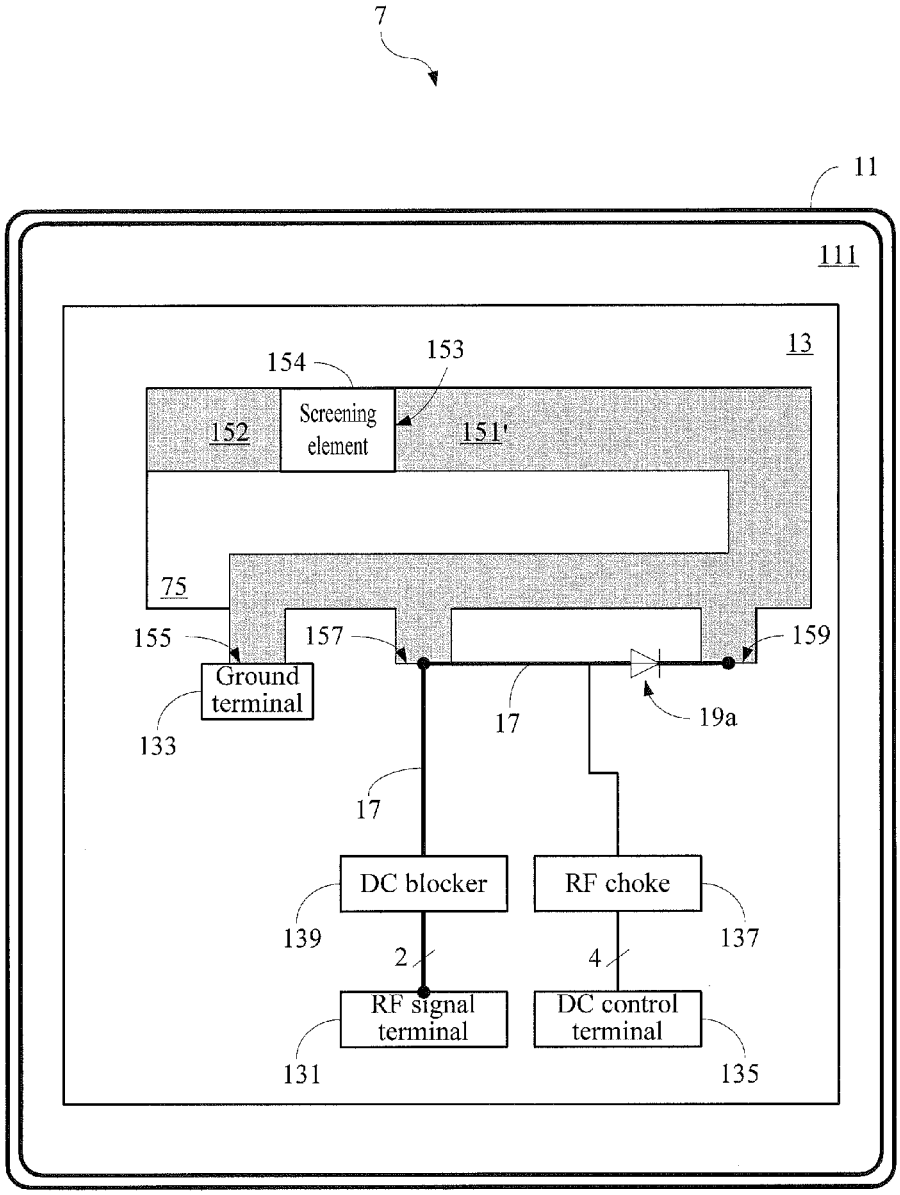
FIG. 6 is a schematic plan view of a handheld device 7 according to the third embodiment of the present invention.

1: handheld device
11: housing
111: receiving space
13: circuit board
131: RF signal terminal
133: ground terminal
135: DC control terminal
137: RF choke
139: DC blocker
15: planar antenna
151: first radiator
151': first radiator
152: second radiator
153: open terminal
154: screening element
155: short terminal
157: first feeding terminal
159: second feeding terminal
17: transmission line
19: switch element
19*a*: diode element
2: RF signal
3: handheld device
4: DC signal
5: handheld device
55: planar antenna
7: handheld device
75: planar antenna
|S11|: reflection coefficient

The invention claimed is:

1. A planar antenna, comprising:

a first radiator, comprising:

an open terminal;

a short terminal, being coupled to a ground terminal;

a first feeding terminal, being formed between the open terminal and the short terminal, and coupled to a radio frequency (RF) signal terminal; and a second feeding terminal, being formed between the open terminal and the first feeding terminal, and coupled to the first feeding terminal and the RF signal terminal via a transmission line and a single switch element;

wherein when the switch element is turned off, the second feeding terminal is physically coupled with neither the ground terminal nor the RF terminal via the switch element and an RF signal outputted by the RF signal terminal is fed from the first feeding terminal to the first radiator so that the first radiator resonates at a first central frequency, and when the switch element is turned on, the first feeding terminal is coupled with the second feeding terminal via the transmission line and the RF signal outputted by the RF signal terminal is fed at least from the second feeding terminal to the first radiator so that the first radiator resonates at a second central frequency that is higher than the first central frequency.

2. The planar antenna as claimed in claim 1, further comprising a second radiator, the second radiator being coupled to the open terminal of the first radiator via a screening element so that the first radiator and the second radiator further resonate at a third central frequency when the switch element is turned off and at a fourth central frequency when the switch element is turned on.

3. The planar antenna as claimed in claim 2, wherein the first central frequency is higher than the third central frequency, and the second central frequency is higher than the fourth central frequency.

4. The planar antenna as claimed in claim 1, wherein the switch element is a diode element, and the diode element is coupled to a direct current (DC) control terminal so that the DC control terminal controls an on/off state of the diode element by outputting a DC signal.

5. The planar antenna as claimed in claim 4, wherein the diode element is coupled to the DC control terminal by an RF choke, and the RF choke is configured to block the RF signal flowing into the DC control terminal.

6. The planar antenna as claimed in claim 5, wherein the first feeding terminal is coupled to the RF signal terminal by a DC blocker, and the DC blocker is configured to block the DC signal flowing into the RF signal terminal.

7. A handheld device, comprising:

a housing, being configured to define a receiving space;

a circuit board, being disposed in the receiving space and comprising a radio frequency (RF) signal terminal and a ground terminal; and a planar antenna, being disposed in the receiving space and comprising:

a first radiator, comprising;

an open terminal;

a short terminal, being coupled to the ground terminal;

a first feeding terminal, being formed between the open terminal and the short terminal, and coupled to the RF signal terminal; and a second feeding terminal, being formed between the open terminal and the first feeding terminal, and being coupled to the first feeding terminal and the RF signal terminal via a transmission line and a single switch element;

wherein when the switch element is turned off, the second feeding terminal is physically coupled with neither the ground terminal nor the RF terminal via the switch element and an RF signal outputted by the RF signal terminal is fed from the first feeding terminal to the first radiator so that the first radiator resonates at a first central frequency, and when the switch element is turned on, the first feeding terminal is coupled with the second feeding terminal via the transmission line and the RF signal outputted by the RF signal terminal is fed at least from the second feeding terminal to the first radiator so that the first radiator resonates at a second central frequency that is higher than the first central frequency.

8. The handheld device as claimed in claim 7, wherein the planar antenna further comprises a second radiator, the second radiator is coupled to the open terminal of the first radiator via a screening element so that the first radiator and the second radiator further resonate at a third central frequency when the switch element is turned off and at a fourth central frequency when the switch element is turned on.

9. The handheld device as claimed in claim 8, wherein the first central frequency is higher than the third central frequency, and the second central frequency is higher than the fourth central frequency.

10. The handheld device as claimed in claim 7, wherein the switch element is a diode element, and the diode element is coupled to a direct current (DC) control terminal of the circuit board so that the DC control terminal controls an on/off state of the diode element by outputting a DC signal.

11. The handheld device as claimed in claim 10, wherein the diode element is coupled to the DC control terminal by an RF choke, and the RF choke is configured to block the RF signal flowing into the DC control terminal.

12. The handheld device as claimed in claim 11, wherein the first feeding terminal is coupled to the RF signal terminal by a DC blocker, and the DC blocker is configured to block the DC signal flowing into the RF signal terminal.

* * * * *